US005378377A

United States Patent [19]

Graf

[11] Patent Number: 5,378,377

[45] Date of Patent: Jan. 3, 1995

[54] PROCESS AND APPARATUS FOR REMOVING LIQUID FROM FAST MOVING THREADS

[75] Inventor: Felix Graf, Winterthur, Switzerland

[73] Assignee: Rieter Machine Works, Ltd., Winterthur, Switzerland

[21] Appl. No.: 97,309

[22] Filed: Jul. 23, 1993

Related U.S. Application Data

[63] Continuation of Ser. No. 702,821, May 20, 1991, abandoned.

[30] Foreign Application Priority Data

May 18, 1990 [CH] Switzerland ..... 01689/90-1

[51] Int. Cl.[6] ..... B01D 17/038; D01H 13/30

[52] U.S. Cl. ..... 210/787; 34/312; 34/459; 34/633; 34/636; 34/651; 57/352; 57/354; 264/101; 264/103

[58] Field of Search ..... 34/8, 15, 18, 23, 148, 34/152, 159, 161, 167, 168; 28/240, 271; 57/352, 354, 355, 357; 210/512.1, 787, 804, 806, 808, 360.1, 770, 771; 264/101, 102, 103

[56] References Cited

U.S. PATENT DOCUMENTS

| | | | |
|---|---|---|---|
| 79,412 | 6/1868 | Sweet | 34/148 |
| 1,083,005 | 12/1913 | Desautels et al. | 57/352 |
| 1,770,310 | 7/1930 | Karplus | 264/101 |
| 1,990,617 | 2/1935 | Sanders et al. | 210/360.1 |
| 2,340,577 | 2/1944 | Bradshaw | 57/352 |
| 2,579,999 | 5/1952 | Knopp | 34/159 |
| 2,816,660 | 12/1957 | Bounin | 210/770 |
| 3,002,804 | 10/1961 | Kilian | 8/130.1 |
| 3,045,315 | 7/1962 | Dusenbury | 28/240 |
| 3,701,182 | 10/1972 | Gasser et al. | 34/152 |
| 4,114,357 | 9/1978 | Grieve | 57/354 |
| 4,116,396 | 9/1978 | Fluck | 242/157 R |
| 4,217,323 | 8/1980 | Foster et al. | 28/240 |
| 4,666,590 | 5/1987 | Sano et al. | 210/360.1 |
| 4,691,450 | 9/1987 | Glaser et al. | 34/23 |
| 4,756,169 | 7/1988 | Pignal | 34/8 |
| 4,773,211 | 9/1988 | Stahlecker et al. | 57/352 |
| 5,046,225 | 9/1991 | Graf | 28/240 |

FOREIGN PATENT DOCUMENTS

| | | | |
|---|---|---|---|
| 0518025 | 9/1981 | Australia | 57/352 |
| 2158932 | 5/1973 | Germany | 28/240 |
| 507782 | 6/1939 | United Kingdom | 57/352 |

*Primary Examiner*—Joseph W. Drodge
*Attorney, Agent, or Firm*—Francis C. Hand

[57] ABSTRACT

Excess liquid is removed from a fast-moving thread, in that the latter is deflected, so that the liquid is hurled off, the hurled off liquid is removed from the thread, in that the thread is passed through a closed chamber, where a vacuum is produced in order to facilitate liquid evaporation and in that the thread is led through a narrow gap, so that the layer directly surrounding the thread and travelling therewith is peeled off. The combination of these drying effects constitutes one process stage. Advantageously, this process stage is performed several times in direct succession, so that in the case of a thread-protecting, small deflection angle a good thread drying can be achieved. The process is performed by an apparatus comprising several chambers (K.1-3) connected in series in the thread movement direction, the thread being deflected at the inlet and/or outlet with respect to each chamber by a deflection element (U.1-4) and passes through a narrow gap (S.1-). The chamber walls (20.1-4), which carry the thread passage, are inclined away from the thread in the gravity direction. The hurled off liquid, under the influence of gravity flows through corresponding passages, which interconnect the chambers and passes into the final chamber in the thread movement direction and is sucked off from the latter.

35 Claims, 5 Drawing Sheets

PROCESS AND APPARATUS FOR REMOVING LIQUID FROM FAST MOVING THREADS

This is a continuation, of application Ser. No. 07/702,821 filed on May 20, 1991, now abandoned.

This invention relates to a process and an apparatus for removing liquid from fast-moving or high-speed threads.

Production processes for synthetic threads comprising a plurality of fibrils often include one or more process steps linked with a treatment of the thread with a liquid. Such process steps are e.g. rapid cooling, stretching, drawing, dyeing, impregnating or texturing such threads. Such liquid treatment processes are preferably performed in closed chambers, which have narrow inlets and outlets for the thread or threads. Although the liquid treatment chambers and, in particular, their thread outlets are designed in such a way that the liquid remains in the chamber and only small quantities can pass through the openings, it is still not possible to prevent the threads passing out of the chamber from carrying with them liquid, which is then hurled off the thread guidance elements following the liquid treatment chamber, accompanied by spray mist formation. Such spray mists dirty adjacent machine parts and represent a loss of treatment liquid, which should advantageously be avoided. Despite spray mist formation, the threads still carry a large amount of liquid even after the thread guidance elements and then have to be dried, which involves considerable energy quantities.

It is known that by deflecting the thread carrying the liquid, part of the liquid is hurled off and that through air blown at right angles to the thread movement direction, the liquid can partly be blown off the thread. These effect are in particular known as undesired effects on thread guides and in whirling or y-forming nozzles, which follow the liquid treatment, However, they are also used for actively removing liquid from the thread, such as is described e.g. in U.S. Pat. No. 3,002,804 and European patent 251,799. However, these processes only make it possible to remove part of the liquid from the thread.

Accordingly, it is an object of the invention to effectively remove a substantial amount of liquid from a travelling thread after the thread undergoes a liquid treatment.

It is another object of the invention to be able to regulate the liquid proportion to be removed from a thread after a liquid treatment.

It is another object of the invention to recover liquid from a liquid treated thread for reuse in a liquid treatment process.

It is another object of the invention to remove excess liquid from a thread with minimum energy and with the thread treated sufficiently carefully to permit use for very sensitive threads and in any stage of a thread production process.

It is another object of the invention to use a minimum braking action on the thread so that the thread can also be used immediately following a stretching chamber.

It is another object of the invention to be able to remove liquid from a thread travelling at high thread speeds, i.e. above 200 m/min.

The invention is directed to a process and apparatus for removing excess liquid from a fast-moving thread.

The process includes the steps of passing a thread having entrained liquid therein through a closed thread guide and deflecting the thread at a predetermined point within the closed thread guide over a predetermined angle in order to effect hurling of liquid from the thread. In addition, the liquid which is hurled from the thread is removed from the thread guide while a part of the air flow flowing with the thread is deflected at the point of deflection in a direction away from the thread.

In accordance with the process, the thread may be deflected a plurality of times while passing through the closed thread guide.

The apparatus includes a closed thread guide for passage of at least one thread having entrained liquid therein, at least two angularly disposed wall parts in the guide to separate the guide into at least a pair of chambers with the wall parts being spaced apart to define a gap for passage of a thread therethrough and a deflection element adjacent the gap for deflecting the thread in passing from one chamber to the other chamber in order to effect hurling of liquid from the thread onto at least one of the wall parts for removal of liquid.

In one embodiment, the apparatus is provided with a plurality of deflection elements and a plurality of gaps which are disposed along a common plane with the deflection elements alternating on opposite sides of the plane in the direction of thread movement.

In another embodiment, a plurality of deflection elements and a plurality of gaps are disposed along a common curved path.

These and other objects and advantages of the invention will become more apparent from the following detailed description taken in conjunction with the accompanying drawings wherein:

FIG. 1 illustrates the operating principle of the inventive process on one process stage;

FIGS. 2*a* to 2*d* diagrammatically show different exemplified apparatus variants;

Figure 5:
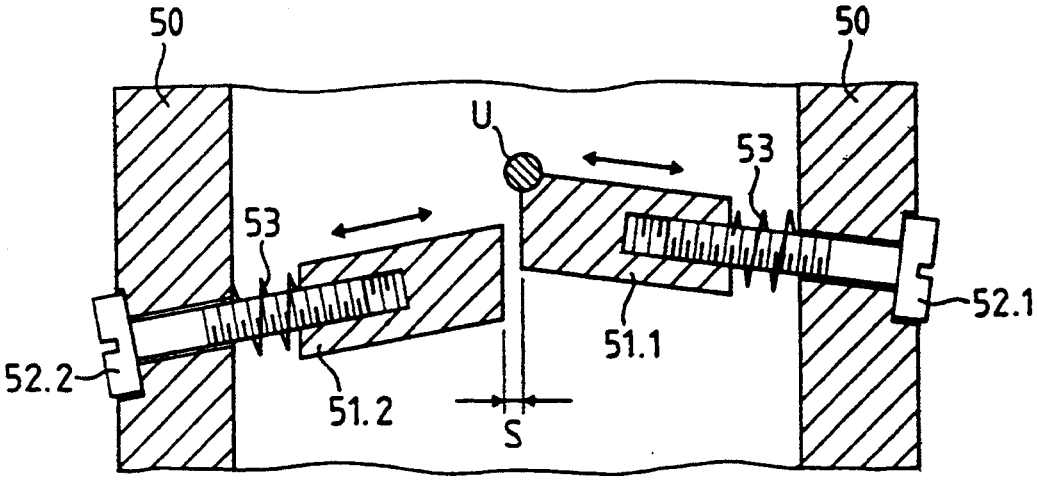
Figure 6:
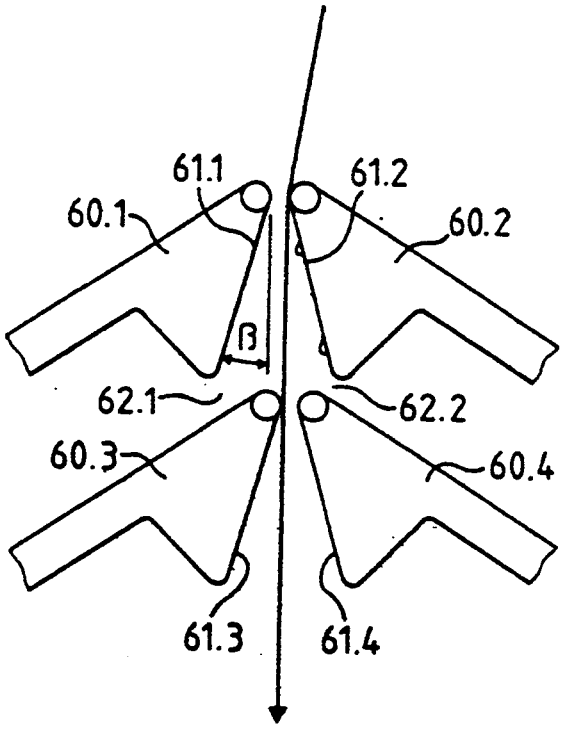

FIG. 5 diagrammatically shows an embodiment for adjustable chamber partitions; and FIG. 6 shows a further variant, in which by a corresponding construction of the individual chambers, a better liquid outflow is achieved.

The inventive process is a combination of various partial processes suitable for the removal of liquid from fast-moving threads. On the one hand, the thread is deflected and in known manner this is accompanied by liquid being hurled from the thread as a result of the centrifugal force, whilst on the other hand the liquid is deflected away from the thread running zone. The complete process takes place in a closed chamber, in which the through-travelling thread produces a vacuum, which makes it easier to evaporate the liquid. This vacuum can be increased by additional means. In a fourth partial process, the air directly surrounding the thread and entrained by it is peeled from the thread and replaced. In the latter, it is obvious that the speeding up of the air in the thread running direction and the resulting shear forces between the thread and the surrounding air have a drying effect on the thread.

The process stage combined from the four aforementioned partial processes is preferably carried out in a successive manner and optionally with slightly varying process parameters and this preferably takes place three or four times. This makes it possible to achieve a high drying effect with only a very small deflection angle, which has a much greater protective effect on the thread than a single deflection step about a correspondingly larger deflection angle. The process also only has a very slight braking action on the thread, so that it can be used following a stretching bath, without part of the stretching process only taking place during the drying process.

Figure 1:
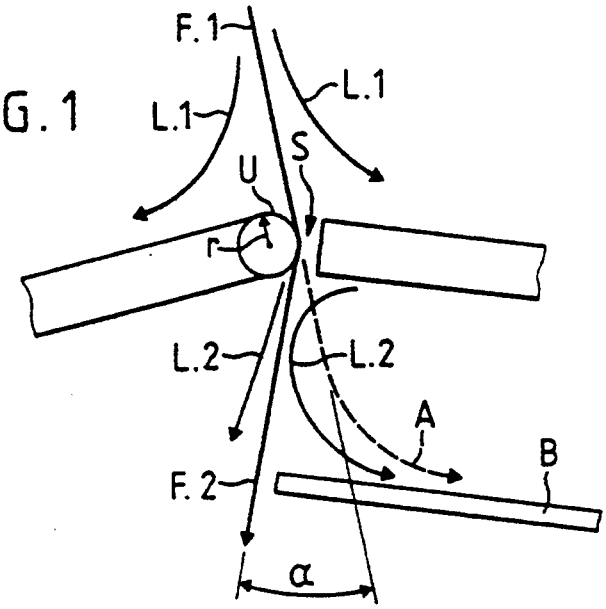

FIG. 1 very diagrammatically shows a process stage of the inventive process. A wet thread F.1 is deflected by a deflecting element U and liquid is hurled therefrom (broken arrow A). The hurled off liquid is deflected away from the thread by a baffle plate B, which is inclined away from the thread in the gravity direction. Whilst running over the deflection element U, the thread simultaneously passes through a narrow gap S, so that the air directly surrounding the thread is peeled from the latter and this is indicated in the drawing by the continuous arrows L.1. Following the gap S, the thread F entrains new surrounding air (continuous arrows L.2), which must be correspondingly accelerated. The process stage is performed in a chamber surrounding the thread in a closed manner, with the exception of the narrow thread inlet and outlet, in which the passing-through thread produces a vacuum. The thread leaves this process stage as a drier thread F.2 and is advantageously passed into one or more, directly following and identically constructed process stages, so that the thread can be gradually dried to a desire dryness level.

The variable process parameters in an inventive process stage for removing excess liquid from a fast-moving thread are:

- the deflection angle $\alpha$ and the deflection radius r, which are both limited by the thread speed, in conjunction with the necessary protection of the thread and the allowed thread braking;
- the width of the gap S; and
- the distance between the deflecting element U and the baffle plate B, the pressure prevailing around the thread and which is determined by the thread inlet and outlet and the thread speed and by the necessary liquid suction which, if necessary, can be reduced to such an extent that liquid evaporation occurs.

The drying effect of the process stage is greater with a larger deflection angle$\alpha$, a smaller deflection radius r, a narrower gap S and lower pressure.

A process variant to that illustrated in FIG. 1 involves the thread deflection and its passage through the narrow gap being locally separated.

Figure 2A:
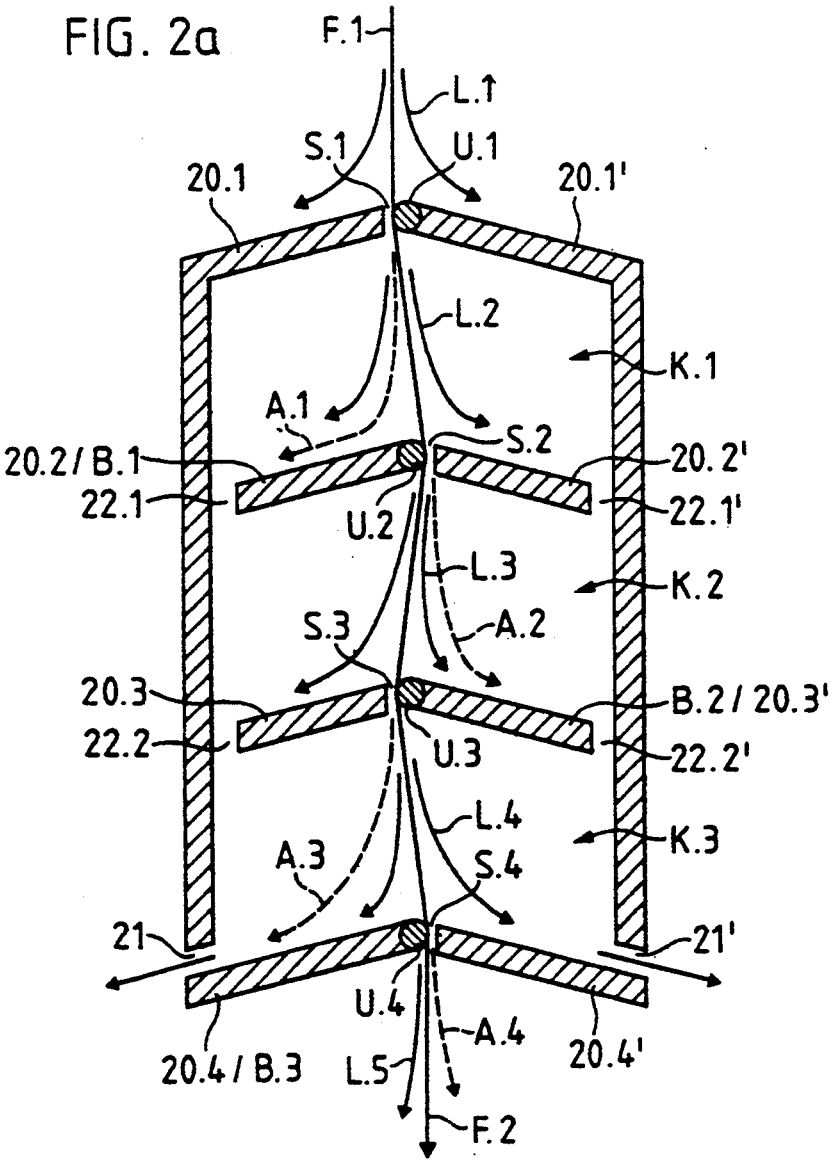

FIG. 2*a* illustrates how the process used for removing liquids from fast-moving threads and which e.g. comprises four process stages in the manner described in conjunction with FIG. 1, can take place in a diagrammatically illustrated apparatus. The liquid-charged, wet thread F.1 is e.g. passed through three chambers K.1–3 and leaves the chamber K.3 as a dry thread F.2, from which most of the liquid has been removed. On entering and leaving each chamber, the thread is deflected by a small deflection angle a of preferably 0.5° to 10°, and for this purpose preferably use is made of deflection elements U.1–4 with a rounding radius r of 0.5 to 5 mm. The deflection angle is advantageously no larger, because a small deflection angle better protects the thread and by the multiple deflection thereof liquid-separating effects can be obtained greater than those obtained with a single deflection by a larger deflection angle. Whenever deflected, the thread passes through a narrow gap S.1 1, which preferably has a width representing 2 to 10 times the diameter of an individual fibril contained in the thread and which is e.g. 0.10 mm.

Figure 2B:
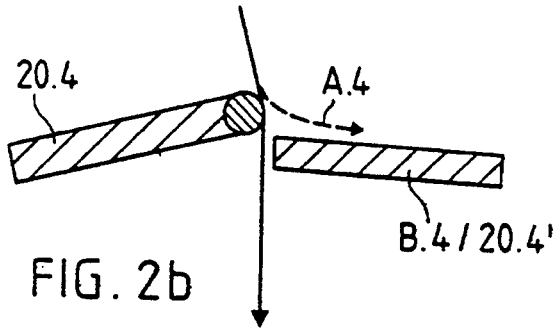

The walls 20.1–4 terminating the chambers in the thread running direction and separating them from one another carry the deflection elements U.1–4, form the gaps S.1–4 and simultaneously function as baffle plates B.1–4, which deflect from the thread the liquid hurled off in the form of spray mist A.1–3, in that they are inclined in the direction of gravity. In FIG. 2*a* the walls 20.1–4 are shaped in such a way that their two parts (e.g. 20.1 and 20.1') have the same height on both sides of the gap in the thread direction. It would also be conceivable to displace these heights in the thread direction, so that one wall part follows the other in the thread direction. For the process diagram shown in FIG. 2*a*, there are clearly no baffle plates for the fourth and last process stage. If the wall parts 20.4 and 20.4' are reciprocally displaced in the thread running direction in the manner indicated in FIG. 2*b*, the wall parts 20.4' can partially fulfil the function of a baffle plate B.4.

The chambers K.1–3 are sealed from the outside with the exception of the thread inlet, which constitutes the first gap S.1 through which the thread passes, the thread outlet, which constitutes the last gap S.4 and the suction openings 21, 21', which are used for sucking off the liquid which has collected in the chambers. As a vacuum must be produced in the chambers by the fast-moving thread, the liquid must be sucked actively out of the apparatus. The individual chambers are interconnected by the openings 22.1 and 22.2 (or 22.1' and 22.2'). These openings and the suction openings 21.1 and 21.1' are in each case arranged on the bottom point of the chambers in the gravity direction, so that the liquid occurring in the chambers is moved by gravity from one chamber into the next and from the last to the suction means.

With the process described in conjunction with FIG. 2, it is e.g. possible to dry to a moisture level of approximately 11% a completely soaked thread of 110dtex f34 of PA66 by deflecting four times by 3°, 6°, 6° and 3°, i.e. 18° in all, in the case of a movement speed of 3000 m/min, so that following rolls, thread guides and the entire exit zone remain substantially dry. The energy consumption for the process (sucking off) is low, because the flow cross-section over the inlet and outlet is very small.

The apparatus illustrated by FIG. 2*a* has a construction based on the fact that the general thread running direction corresponds to the gravity direction. This is an advantageous arrangement, because, as a result the apparatus can be kept very simple. However, the process principle does not make it necessary for the general thread movement direction to be in the direction of gravity. Apparatuses for other thread running directions will in particular differ through a different construction of the walls 20.1–4.

Figure 2C:
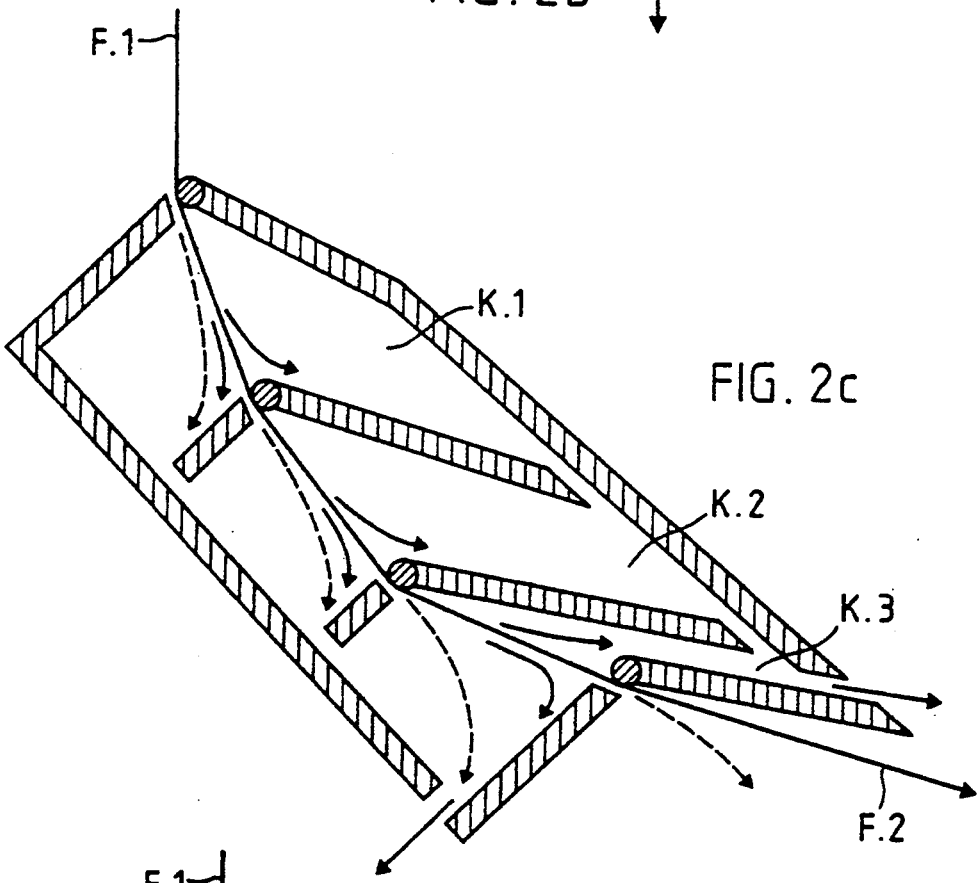

The variant of the process illustrated by FIG. 2*a* is in particular suitable for points in the master process, where there is no need to deflect the thread. Therefore, the thread is alternately deflected in different directions in such a way that the sum of the deflection angles of the individual process stages is equal to zero, i.e. the thread is not deflected over the entire process. If the process for removing excess liquid from a thread is used at a point of the master process where the thread must be deflected, then it is possible to provide for the partial stages of the process deflections in the same direction in such a way that the sum of the deflection angles in the process stages is equal to the desired deflection angle. A corresponding diagram for a process with four partial stages is illustrated in FIG. 2*c*.

Figure 2D:
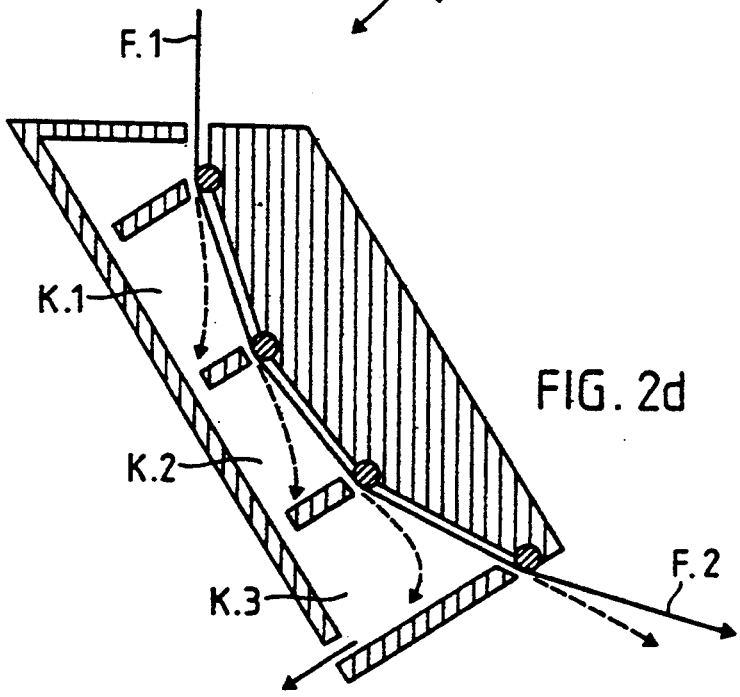

As most of the liquid is hurled off in the chamber part facing the deflection element and consequently in particular on this thread side baffle plates B are required, it would also be conceivable to have apparatuses only having chambers on the thread side remote from the deflection elements. An example of a corresponding apparatus variant is shown in FIG. 2*d*. As in FIG. 2*c*, this apparatus enables the process to be performed in four partial process stages and is suitable for a deflection point in the master process.

Further variants to the process described in conjunction with FIGS. 2*a*–2*d* can be that no thread deflection takes place at the inlet into the first chamber in the thread movement direction and at the outlet from the last chamber. In addition, by separate suction all the chambers can be connected to a central suction means.

Figure 3:
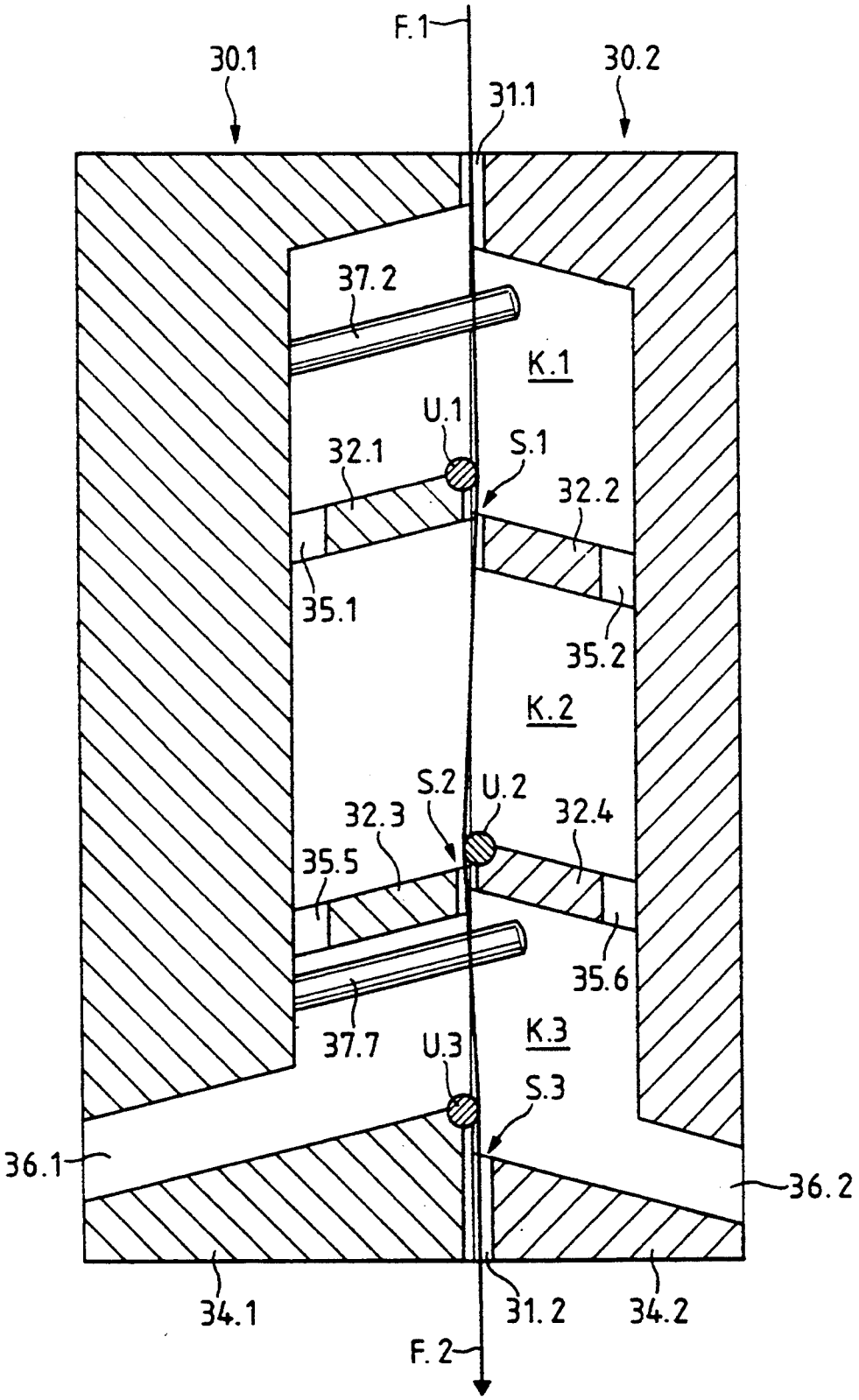
FIG. 3 shows a section parallel to the thread direction through an exemplified embodiment of the apparatus for performing the inventive process.
Figure 4:
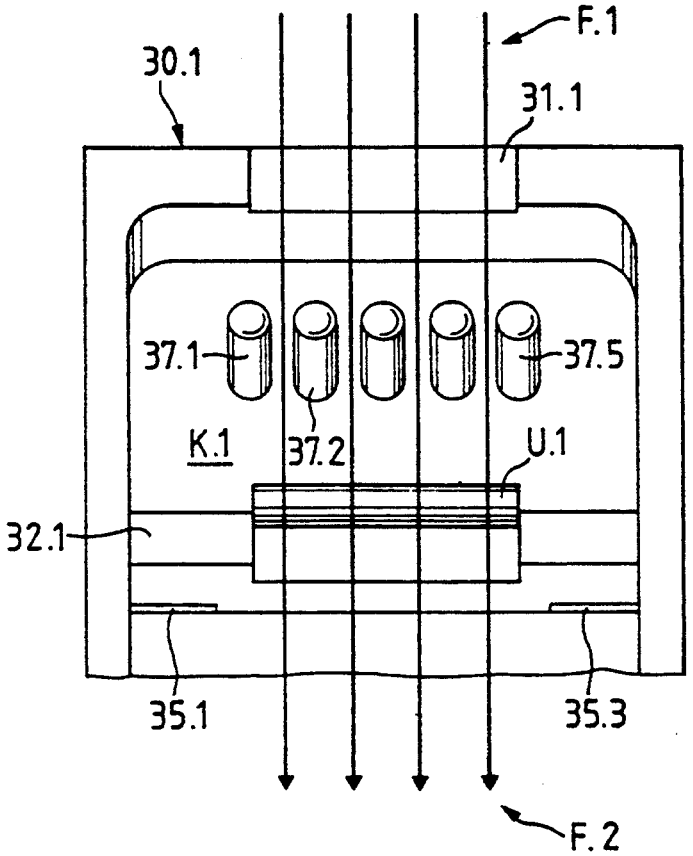
FIG. 4 is a plan view of one chamber half of the apparatus according to FIG. 3.

FIGS. 3 and 4 show as a detailed exemplified embodiment an apparatus enabling the described process to be performed. The apparatus makes it possible to free from liquid four threads running in parallel in the gravity direction. The apparatus comprises three chambers K.1–3 and three deflection elements U.1–3. No thread deflection takes place at the inlet into the first chamber K.1 in the thread movement direction. The apparatus comprises two parts 30.1 and 30.2, whereof the block part 30.1 is preferably fixed to an apparatus frame, whilst the cover part 30.2 can be flapped e.g. by means of a closure and hinging with respect to the block part 30.1, so that the threads can be passed through. The functions of the two parts 30.1 and 30.2 in connection with the process are identical. The plane separating the two apparatus parts 30.1 and 30.2 is that in which are located all the threads entering and leaving the apparatus.

FIG. 3 shows this embodiment of the apparatus as a section through the two apparatus parts 30.1 and 30.2 at right angles to the plane separating the two parts and parallel to the thread movement direction. The threads pass through an entrance slot 31.1, which is perpendicular to the sectional plane, into the first chamber K.1 and pass out of the third chamber K.3 through a corresponding exit slot 31.2. One of the threads is shown in FIG. 3 as a thread F.1 entering the apparatus in soaked form and which leaves as the dry thread F.2.

The three chambers K.1–3, which comprise two identical chamber halves falling away from the thread movement in the gravity direction and whereof in each case one is located in the block part 30.1 and in the cover part 30.2, are closed with respect to the outside through the outer walls of the two apparatus parts and are separated from one another by the chamber partitions 32.1–4. The latter are so reciprocally displaced that they follow one another in the thread movement direction in the following order: 32,1, 32,2, 32,4, 32,3, 34,1, 34,2. The two latter are not in fact chamber partitions, but the thread outlet-side chamber outer walls. The partitions 32.1–4 are formed in such a way that, if the two apparatus parts 30.1 and 30.2 engage with one another, they leave open for the moving through threads a gap S.1 and S.2, whose width corresponds to 2 to 10 times the fibril diameter. To the first edges, facing the threads in the thread movement direction, of the partitions 32.1 and 32.4 and to the corresponding edge of the outer wall 34.1 of the block part 30.1 forming the thread exit, three thread deflection elements U.1–3 are fitted at right angles to the thread movement direction and parallel to the plane in which the threads pass into and out of the apparatus. This takes place on corresponding ledges in such a way that the deflection elements U.1–3 project by a small amount over the plane separating the two apparatus parts 30.1 and 30.2 and, in this way, deflect the threads out of their linear movement in the plane between the entrance slot 31.1 and the exit slot 31.2. The deflection elements U.1–3 aide preferably ceramic bars with an easy-sliding surface. In an apparatus of the type shown in FIG. 3 in which all the walls 32.1, 32.4 and 34.1 carrying a deflection element are identically constructed, the deflection angle can be varied to a minor extent by fitting deflection bars of different diameters. A corresponding apparatus in which several process parameters can be varied to a further degree will be described in conjunction with FIG. 5.

The chamber K.1 is connected to the chamber K.2 with e.g. four passages (35.1 and 35.2 in FIG. 3; 35.1 and 35.3 in FIG. 4), which advantageously emanate from the bottom points in the chamber in the gravity direction. Similar passages 35.56 connect chamber K.2 to chamber K.3. The chamber K.3 is connected to a suction means by e.g. two passages 36.1 and 36.2 through the chamber outer wall, which advantageously issue into the chamber K.3 at the bottom chamber points and must have the same angle of inclination as the chamber. Ten separating bars 37.1–10 are also fitted between the individual threads in the chambers K.1 and K.3. They ensure that on passing through the apparatus, the threads are not in contact and cannot cause any other disturbance. They are advantageously also inclined away from the threads in the gravity direction, so that liquid droplets deposited thereon can flow away from the threads.

FIG. 4 shows a detail plan view of the inside of the block part 30.1 in the vicinity of the chamber K.1 and particularly illustrates the thread movement between the separating bars 37.1–5 and over the deflection element U.1.

FIG. 5 shows a detail of another exemplified apparatus variant with adjustable chamber wall parts. In this apparatus, the chamber wall parts can be displaced with respect to the separating plane of the two chamber parts.

Thus, in an arrangement with all identical chamber wall parts and identical deflection elements, not only can the deflection angle $\alpha$ of each process partial stage, but also the width of each individual gap S can be varied. It is possible with such an apparatus to adjust the process in such a way that the thread leaving the apparatus has a precisely defined residual moisture content. An exemplified use for this apparatus is the dosing of spinning finish. The thread is initially impregnated with a spinning finish excess and then subjected to the process with process parameters adjusted in this way (deflection angle a, gap width S, vacuum U), so that on leaving the apparatus the thread contains the desired spinning finish quantity.

FIG. 5 shows an exemplified variant for the adjustable chamber wall parts. The two chamber wall parts 51.1 and 51.2 are not connected in fixed manner to the chamber outer walls 50 and are instead guided therein, being adjustable e.g. with the aid of adjusting screws 52.1 and 52.2. In order to obtain clearly defined adjustment positions between the chamber wall part and the chamber outer wall a spring 53 is, in each case, provided which presses the chamber wall part into its position furthest from the chamber outer wall. An adjustment of the chamber wall part 51.1, which carries the deflection element U, is mainly brought about by adjusting the deflection angle a. An adjustment of the chamber wall part 51.2 relative to the position of the chamber wall part 51.1 given by the deflection angle leads to an adjustment of the width of the gap S, which is e.g. adjustable between 0.05 and 0.1 mm.

FIG. 6 shows another exemplified variant for the apparatus for removing liquid from fast-moving threads and corresponds to the apparatuses of FIGS. 2*a*–2*d* and 3 with respect to the function thereof and also the basic construction. However, this apparatus variant differs from the variant described up to now through the construction of the chamber partitions 60.1/2/3/4, which are formed in such a way that the chambers surrounding the threads are smaller and in particular the angle b between the gravity and liquid-removing part of the chamber walls 61.1/2/3/4 (draining off elements) is smaller. In such a chamber, the liquid flows away better from the thread and this can also be attributed to a less strong whirling action of the chamber air acting against this liquid movement and a better gravity utilization. The angle b is advantageously between 10° and 60°.

It is also advantageous to choose the width of the channel 62.1 and 62.2 leading out of the chambers in such a way that the free height of fall for the drops is small. The width of the channel at the point where the channel enters the chamber is advantageously between 0.5 and 5 mm.

The chamber walls according to FIG. 6 can be equipped with separate deflection elements, or they can be shaped from a suitable material such as sintered oxides, e.g. alumina, in such a way that they can serve in one piece form as the chamber partition, draining off element and deflection element. In accordance with FIG. 5, they can be adjustable at right angles to the thread movement direction enabling the apparatus action to be adjusted for a specific use.

Due to the fact that the liquid carried with the thread in a closed thread guide is hurled off the thread by at least one movement direction deflection thereof and whereby during each deflection, the hurled off liquid is led away from the thread along draining off elements, which are inclined at an angle, preferably to the force of gravity and which are formed by the chamber walls or adjustable plates and the draining off elements partly separate from the thread the air flow travelling with it and from within each chamber a local flow which further assists the removal of the liquid from the thread, it is possible at each deflection point to obtain a protecting, extremely effective, but also planned liquid removal from the fast-moving thread. The liquid led away at the deflection points can then be collected and jointly removed.

The local flow resulting from the air separation in the chambers forms an eddy, which makes finer liquid particles or droplets strike the chamber walls and are separated in such a way that the flow part returning to the thread contains less liquid than the part leading away from the thread. Thus, a process-based dynamic equilibrium is formed.

What is claimed is:

1. A process for removing excess liquid from a fast-moving thread comprising the steps of passing a thread having entrained liquid therein through a fixed path in a thread guide with a linear movement and at a high linear speed;

deflecting the thread at at least one predetermined point in said fixed path within the thread guide over a predetermined angle whereby said high linear speed of the thread is sufficient to effect hurling of liquid from the thread under centrifugal force at said at least one point;

removing the liquid hurled off the thread from the thread guide; and deflecting a part of an air flow flowing with the thread at said at least one predetermined point from the thread in a direction away from the thread.

2. A process as set forth in claim 1 which further includes the steps of deflecting the thread in the thread guide at successive spaced apart deflection points.

3. A process as set forth in claim 2 wherein the sum of the angles of deflection of the thread in the thread guide equals zero.

4. A process as set forth in claim 2 wherein the thread is deflected in a common direction at each said deflection point.

5. A process as set forth in claim 2 wherein the thread is deflected at each deflection point over an angle of from 0.5° to 10°.

6. A process as set forth in claim 1 wherein the thread guide is closed and the thread creates a vacuum in the guide during passage through the thread guide.

7. A process as set forth in claim 1 wherein the thread guide is closed and the liquid removed from the thread is drawn out of the thread guide under a controllable suction force.

8. A process as set forth in claim 1 which further comprises the step of passing the thread through a gap within the thread guide to effect deflection of said air flow part, said gap having a width of from 2 to 10 times greater than the diameter of an individual fibril in the thread.

9. A process as set forth in claim 1 wherein the liquid is removed from the thread guide under gravity.

10. A process as set forth in claim 1 wherein the entrained liquid is a spinning finish liquid.

11. A process as set forth in claim 1 wherein said speed is 3000 meters per minute.

12. An apparatus for removing excess liquid from a fast moving thread comprising a thread guide constructed and arranged for passage of at least one thread having entrained liquid therein;

at least two angularly disposed wall parts in said guide separating said guide into a pair of chambers, said parts being spaced apart to define a narrowed gap between said chambers sized for passage of the at least one thread therethrough;

a deflection element adjacent said gap arranged for deflecting the at least one thread in passing from one of said chamber to the other chamber to effect hurling of liquid from the at least one thread; and an inclined baffle plate below said wall parts arranged for receiving the liquid hurled from the thread for removal thereof.

13. An apparatus as set forth in claim 12 which further comprises a plurality of deflection elements and a plurality of gaps disposed along a common curved path.

14. An apparatus as set forth in claim 12 wherein said deflection element is mounted on one of said wall parts to define said gap.

15. An apparatus as set forth in claim 12 wherein each said wall part has an opening communicating said chambers together for draining of liquid from one of said chambers to the other chamber.

16. An apparatus as set forth in claim 12 wherein said deflection element is a ceramic bar with a sliding surface.

17. An apparatus as set forth in claim 12 wherein said gap has a width of 0.05 to 1.0 mm.

18. An apparatus as set forth in claim 12 which further comprises means for moving said wall parts relative to each other to adjust at least one of the size of said gap and the angle of said wall parts.

19. An apparatus as set forth in claim 12 which further comprises a plurality of separating bars in at least one chamber for separating a plurality of threads from each other.

20. An apparatus as set forth in claim 12 wherein each said wall part is disposed on an angle to a vertical plane of from 10° to 60°.

21. An apparatus as set forth in claim 12 which further comprises at least two pairs of said wall parts disposed in vertically spaced relation over gaps of from 0.5 to 5 mm.

22. An apparatus as set forth in claim 12 wherein one of said wall parts and said deflection element are integral in one piece.

23. An apparatus as set forth in claim 22 wherein said piece is made of a sintered oxide.

24. An apparatus for removing excess liquid from a fast-moving thread comprising a thread guide constructed and arranged for passage of at least one thread having entrained liquid therein;

at least two pairs of angularly disposed wall parts in said guide separating said guide into at least three consecutively disposed chambers, each said pair of parts being spaced apart to define a respective gap sized for passage of the at least one thread therethrough; and a plurality of deflection elements within said thread guide, each deflection element being disposed adjacent a respective gap arranged for deflecting the at least one thread in passing from one of said chambers to the next subsequent one of said chambers to effect hurling of liquid from the at least one thread onto at least one of said wall parts disposed below said respective deflecting element for removal of the liquid.

25. An apparatus as set forth in claim 24 wherein said deflection elements are disposed along a common plane with said deflection elements alternating on opposite sides of said plane in the direction of thread passage.

26. An apparatus as set forth in claim 24 wherein said deflection elements are disposed along a common curved path.

27. An apparatus as set forth in claim 24 wherein each said wall part has an opening communicating ones of said chambers together for draining of liquid from one chamber to the other chamber.

28. An apparatus as set forth in claim 24 wherein each said wall part is a plate disposed on an angle to the vertical of from 10° to 60°.

29. In an apparatus for removing excess liquid from a fast moving thread, the combination comprising a pair of angularly disposed plates separating a pair of chambers from each other, said plates being spaced apart and defining a gap sized for passage of a thread therethrough and one of said plates being spaced vertically below the other of said plates at said gap; and a deflection element mounted on said other of said plates above said one plate and in said gap arranged for deflecting the thread in passing from one of said chambers to the other chamber to effect hurling of liquid from the thread onto said one plate.

30. The combination as set forth in claim 29 which comprises a plurality of pairs of said plates disposed in spaced relation to define a plurality of alternating chambers therebetween.

31. The combination as set forth in claim 30 wherein at least some of said plates have an opening therein for draining liquid from respective ones of said chambers to a respective chamber therebelow.

32. In an apparatus for removing excess liquid from a fast moving thread, the combination comprising a plurality of vertically spaced angularly disposed plates; and a plurality of deflection elements, each deflection element being disposed opposite a respective plate and defining a gap therewith sized for passage of a thread therethrough, said deflection elements being disposed along a common curved path arranged to sequentially deflect the thread in a common direction relative to a vertical plane to effect hurling of liquid from the thread onto a respective plate disposed below each respective said deflection element.

33. A process for removing excess liquid from a fast-moving thread comprising the steps of passing a thread having entrained liquid thereon through a fixed path in a thread guide with a linear movement and at a high speed; and deflecting the thread at at least one predetermined point in said fixed path within the thread guide over a predetermined angle whereby said high linear speed of the thread is sufficient to effect hurling of liquid from the thread at said at least one point under centrifugal force to thereby remove the liquid hurled off the thread from the thread guide while deflecting a part of an air flow flowing with the thread at said at least one predetermined point from the thread in a direction away from the thread.

34. A process as set forth in claim 33 wherein the thread guide is closed and the liquid removed from the thread is drawn out of the thread guide under a controllable suction force.

35. A process as set forth in claim 33 wherein said speed is 3000 meters per minute.

* * * * *